US005769048A

United States Patent [19]

Salzmann

[11] Patent Number: 5,769,048

[45] Date of Patent: Jun. 23, 1998

[54] ROCKING PISTON ENGINE AND ROCKING-PISTON COMPRESSOR

[76] Inventor: Willy Ernst Salzmann, Alpenstrasse 1, Zug, Switzerland, CH-6300

[21] Appl. No.: 860,420

[22] PCT Filed: Dec. 27, 1995

[86] PCT No.: PCT/CH95/00312

§ 371 Date: Jun. 24, 1997

§ 102(e) Date: Jun. 24, 1997

[87] PCT Pub. No.: WO96/20332

PCT Pub. Date: Jul. 4, 1996

[30] Foreign Application Priority Data

Jun. 24, 1997 [CH] Switzerland ..... 03 906/94-0

[51] Int. Cl.[6] ..... F02B 75/06

[52] U.S. Cl. ..... 123/197.2; 123/193.6

[58] Field of Search ..... 123/197.2, 197.1, 123/197.3, 197.4, 193.6, 193.4; 92/179

[56] References Cited

U.S. PATENT DOCUMENTS

| | | | |
|---|---|---|---|
| 2,284,645 | 6/1942 | Duffy | 123/197.3 |
| 3,695,150 | 10/1972 | Salzmann | 123/197.3 |
| 4,142,500 | 3/1979 | Davis | 92/179 |
| 4,765,292 | 8/1988 | Morgado | 123/197.3 |
| 4,829,954 | 5/1989 | Morgado | 123/193.6 |
| 4,924,824 | 5/1990 | Parsons | 123/197.4 |
| 5,186,137 | 2/1993 | Salzmann | 123/192.2 |

*Primary Examiner*—David A. Okonsky
*Attorney, Agent, or Firm*—Hazel & Thomas

[57] ABSTRACT

The present inventions concern rocking-piston engines and rocking-piston compressors of high efficiency. This is achieved by an arrangement in which the piston crown lies on a circular cylinder whose center coincides with the center of the connecting rod bearing and the inner face of the cylinder head lies on a circular cylinder whose center coincides with the center of the crankshaft bearing; and whereby these cylinders are in mutual rolling sealing contact in the vicinity of the top dead center. Additional means help to ensure, for an engine, that the crankshaft is driven before the top dead center or, for a compressor, that optimal compression with regard to flow is achieved with the smallest possible dead volume.

14 Claims, 5 Drawing Sheets

ROCKING PISTON ENGINE AND ROCKING-PISTON COMPRESSOR

BACKGROUND OF THE INVENTION

The present rocking-piston engine is the result of many decades of theoretical and practical research and development, partially together with the Federal Institute of Technology, Zurich (Switzerland). The aim has been to achieve decisive benefits with respect to simplicity, compactness, weight, manufacturing costs, smooth running, response, consumption, emissions, servicing and recycling. Applications involving engines of any size and configuration seem to be universally sensible, indeed essential for land and water vehicles (and airplanes), if their needed reduction in size and simplification are to be made at all possible.

BRIEF DESCRIPTION OF THE DRAWINGS

The new inventions arise from the patent claims, and further related features and advantages are explained more precisely with the aid of simplified diagrams using examples, as follows:

DETAILED DESCRIPTION OF THE PREFERRED EMBODIMENTS

Figure 1:
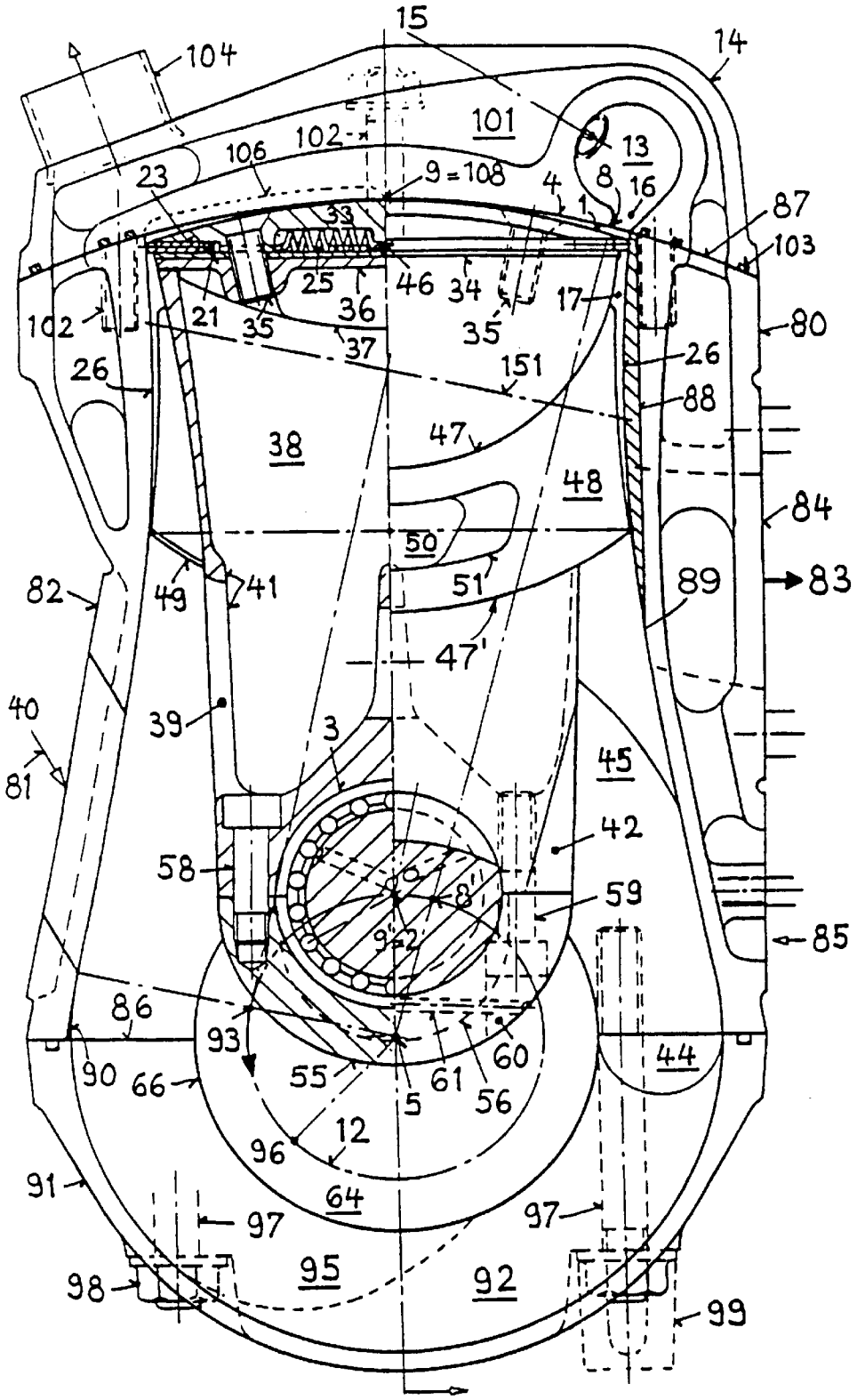
FIGS. 1 and 2 show versions of an experimental engine in front and side elevation.
Figure 2:
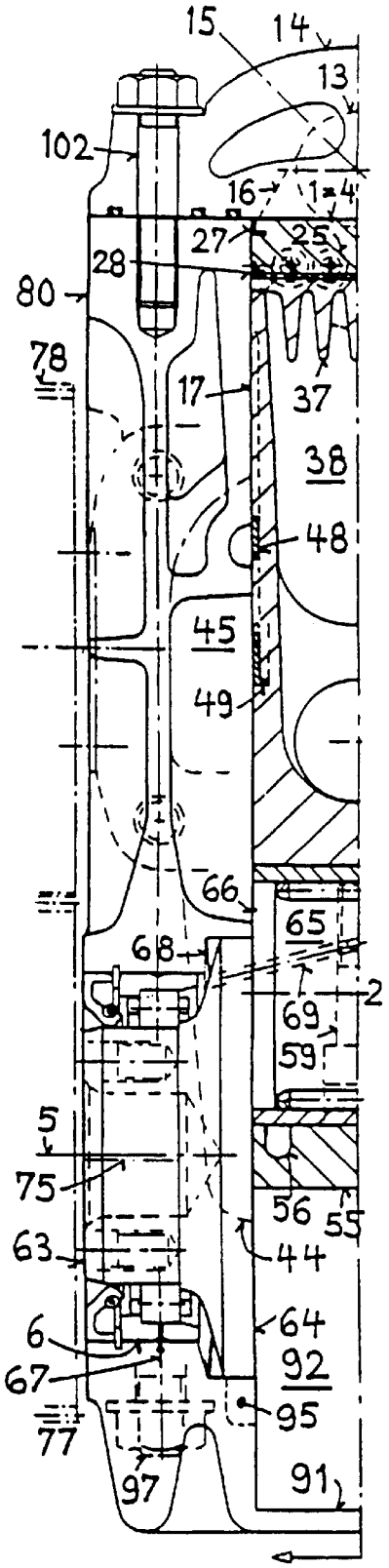
Figure 3:
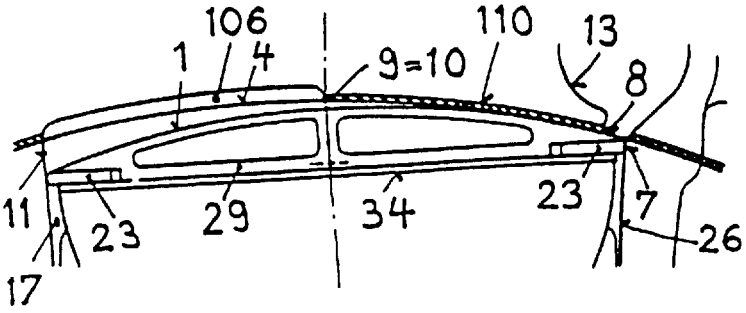
FIG. 3 shows further versions of FIG. 1 with details in another piston position.
Figure 6:
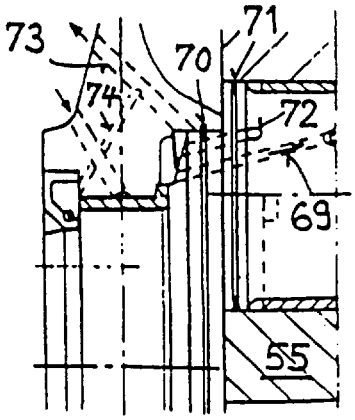
FIG. 6 shows a variation of FIG. 2 with friction bearings in detail.
Figure 7:
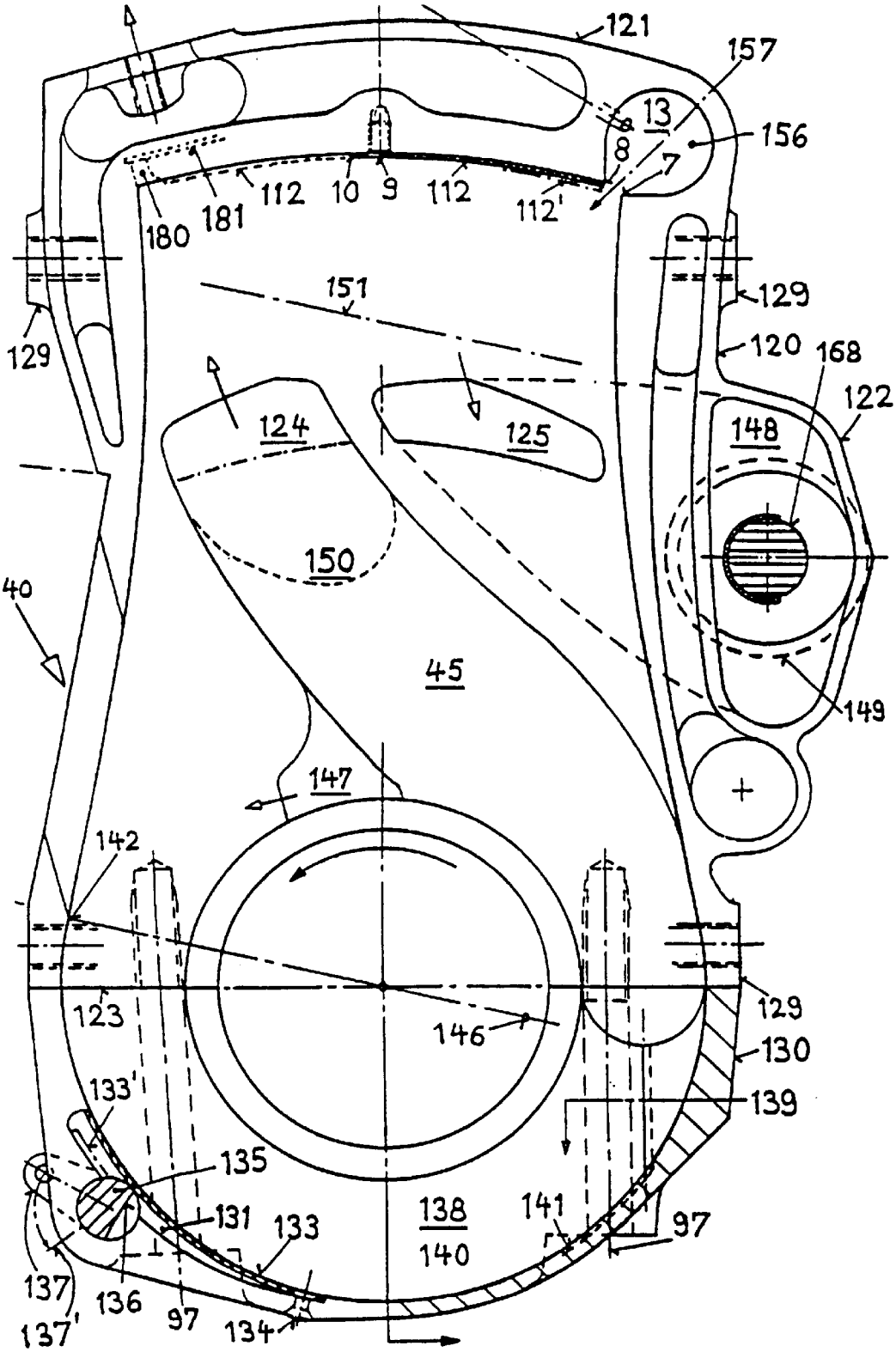

For two-stroke engines long, narrow, rectangular rocking-pistons are optimal; they allow for low, wide gas-exchange ports (FIG. 7) and a short, stiff crankshaft (FIGS. 2 and 6). Squeeze zones on both sides (FIG.9) lead nevertheless to a compact, conventional combustion chamber. On the other hand, the long rocking-pistons offer for the first time a way of avoiding additional braking of the rising piston, which inevitably occurs as a result of pre-injection/pre-ignition and combustion before top dead centre. A short explanation follows:

According to a first embodiment of the present invention, the piston crown 1 lies on a circular cylinder with axis 2 of the connecting rod bearing 3, and the cylinder head inner wall 4 lies at least sectorially on a circular cylinder with axis 5 of the crankshaft bearing 6 (FIGS. 1 to 3). Thus, the wall 4 constitutes the envelope surface of the moving piston crown 1. The following points are important: the advanced side reversal point 7 of the piston motion, the sealing point 8 (FIG. 3), top dead center 9 (reversal point at the end of the piston stroke), the reversal point 10 and the lagging side reversal point 11 (mirror symmetrical to 7). Two of these points also appear on the crank circle 12 as 8' and 9'. For example, a spherical or ellipsoidal combustion chamber 13 for the cylinder head 14 shows, e.g., an injection nozzle and a glow or spark plug 15 in a V configuration, as well as a wide channel 16 to the rectangular, dished cylinder 17. Thanks to a seal (e.g., carbon deposit) between piston crown 1 and piston wall 4 in the region of sealing point 8 (FIG. 3) up to top dead center 9, braking of the piston crown 1, which is still rising as a whole but already falling on the right, can no longer occur. On the contrary, even from the point 8 (at a crank angle of 345° here), driving forces will be exerted on the crankshaft, against which are acting the reaction forces due to further compression of the air intake. Further details of this are shown in FIGS. 3 and 7.

For the design and construction of rocking-piston engines one should refer to earlier publications of the same applicant. The following supplements should therefore suffice for an understanding.

Figure 4A:
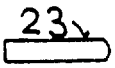
FIGS. 4A to 4C show enlarged front (apex) seals in front elevations.
Figure 4B:
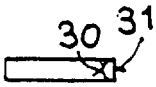
Figure 4C:
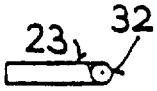

The piston crown 1, which is domed upwards, leaves room for durable piston springs of optimum dimensions, in place of double leaf spring 21, as in FIG. 1 (left). Continuous seal springs 22 (FIGS. 1, 2 and 5) ensure a lasting fit of the front (apex) seals 23, while approximately equally long guide springs 25, which are axially fixed on a piston rib 24, control the front end of the rocking-piston in a hovering fashion between the waisted cylinder walls 26 ("hovering piston"). The side seals 27 and 28 of L section are combined into a seal mesh as in FIG. 3 and attached, e.g., by light ondulated springs. All springs consist of heat-proof material and are tightly fitted vertically into the piston. The front seals 23 and seal mesh 29 form four overlapped butt joints, which are gas-tight even after wear. It is intended that optimized and, if necessary, coated materials should be used. For further reduction in wear, the front seals 23 run as in FIG. 4B on swivelling sealing rods 30, whose outer surfaces 31 are matched to the preferably circularly waisted cylinder walls 26 and therefore always have surface contact. As a further version, FIG. 4C shows a rotating ceramic sealing needle 32. The piston plate 33, which is made, e.g., from ceramic, forged light metal or thin-walled cast steel, is fixed onto the connecting rod cover 36 by means of radial aluminum countersunk screws 35, with an intermediate layer of wear-resistant, replaceable steel plate 34.

This connecting rod cover 36 with stiffening and cooling ribs 37 is made preferably of magnesium die-cast-metal—as is the thin-walled, rectangular sectioned connecting rod blade 38—and is joined to the connecting rod blade preferably by pressure welding. Integral, hollow connecting rods with small wall thickness and strain-reducing invar or carbon fibre reinforcement are, however, possible by using fusion grains or sand core etc. As core fixing the right-angled opening 39 can be used, through which manifold pressure 40 flows in and out for heat transfer from the piston plate 33 and connecting rod cover 36. The strengthening of the edge 41 and the hub chamfers 42 (which guide the manifold pressure into the circulating depressions 44 and channels 45 on both sides) compensate for the weight of the opening 39. The grooves 47/47', which are concentric to the piston center 46, contain flat gas slide valves 48, if necessary filled with edge strengthening 49 and additional guide 50/51. The slide valves 48 hardly follow the sideways rocking motion of the connecting rod blade 38 and, therefore, cover over the exhaust ports as far as the cylinder walls 26.

The semicylindrical connecting rod cover 55 is designed as counterweight to the piston and upper part of the connecting rod and, with regard to its moment of inertia, designed such that the centre of percussion of the oscillating parts 33 to 55 (possibly without slide valves 48) lies at least approximately at the centre 2 of the connecting rod bearing. Thus, the centre 46 of a hypothetically unguided piston would of its own accord trace out an elongated figure eight. The fine transverse oscillations which would thus occur are taken up by the piston guide springs 25. Since hardly any transverse forces caused by gas forces occur between hovering piston and cylinder front walls 26 because of the arced shape of the piston crown 1 whose centre 2 coincides with that of the connecting rod bearing 3, except for its frictional moment, the frictional losses and oil consumption are many times smaller than for conventional plunger pistons. This is of very great significance, especially for two-stroke engines.—For the relatively small external diameter of the connecting rod cover 55 (the degree of charging of the "connecting rod charger" up to inlet closure is in this case only approx. 1.5) a dense material such as steel or brass is necessary, in order to achieve the required rotative moment. Fine adjustment can be achieved using the void 56 in the connecting rod cover 55 or the piston plate 33, as well as by using steel screws 35 of various lengths; this can be checked on a horizontal vibrator. The connecting rod screws 56 are inserted from above; for the engine casing as in FIG. 7 a screwing from underneath is necessary for certain numbers of cylinders, in order that the crankshaft can be fitted and removed. In order to seal the connecting rod charger, e.g., injected plastic plugs 60 fixable by a pin 51 which is slightly kinked in the middle are necessary. The external surfaces 17 and 55 of the connecting rod charger are finely machined, and, e.g., galvanized or coated with PTFE, and make a seal as a result of minimal clearance.

The crankshaft, which is compact, light and stiff, as in FIGS. 1, 2 and 6 consists of the pivots 63, conical-cylindrical crank discs 64 and pins 65 with flanges 66 (for good cover of the crank discs 64). It has a roller bearing and is lubricated appropriately via oil inlet 67. An intermediate seal is achieved by a cup spring 68, oblique bore 69 and oil outlet at the outer edge of the flanges; 66 and/or as in FIG. 6. For intermediate crankshaft bearings (FIG. 8) it is possible to separate the cup springs 68 only in one position and to expand them by bending, which simplifies mounting them in the crankcase. In the case of friction bearing (FIG. 6) the oil feed occurs in a similar way, however, for reasons of cooling (around ten times the frictional heat is generated), oil recycling is necessary to a much greater degree. This occurs between the radial seals 70 and 71, e.g., through borings 72 and 74. A certain amount of oil escape is inevitable, this being essential for lubrication of the connecting rod and piston. The returned oil is reused, since it has no contact with combustion gases, making oil changes unnecessary. For reasons of space the counterweights of the crankshaft are arranged outside the engine, which is either advantageous or disadvantageous, depending on the number of cylinders. Their correct position can be guaranteed unproblematically by slight staggering of a flange boring 75, and a combination of flywheel and belt pulley is intended where applicable. To compensate for vibrations from three cylinders, two mating gear wheels 77 and 78 with counterweight are arranged compactly on each front end (instead of an external connecting shaft), where in each case a single gear made of suitable plastic is considered. Static balancing of the fully machined crankshaft is superfluous.

The cylinder crankcase 80 (see FIGS. 1 and 2) includes the crank assembly, has coolant space as well as channels for gas exchange, and is made of e.g. suitable ribbed cast iron or light metal alloy casting. Air intake 81 occurs via a plane flange 82 for each cylinder individually, the exhaust 83 via a common flange 84, which also includes the coolant inlet 85. The casing, 80 has at the bottom a flat flange 86 at the level of the crankshaft axis 5 and at the top the domed flange 87, which lies on a circular cylinder with axis 5. Machining of the cylinders can be accomplished economically by vertical reaming, but then separate domed inserts 88 are necessary, which can be interchangeable. Without them and underneath them must be machined away, e.g. up to point 89 in an arc-shape, and from there on straight, but at an angle, and a corner piece 90 is necessary. As the simplest and most economical solution, one can use spark erosion, which is also possible and necessary, e.g., at positions 47/47' and 50/51'.

The crank case 91 forms the lower end of the cylinder crankcase 80, which has a semicylindrical hollow space 92 under each connecting rod, which tightly surrounds the moving connecting rod cover 55 and which is part of the cylinder chamber of the integrated, volumetric connecting rod charger. Its point of application 93 (at piston setting 94) can be moved via indentations 95 which have been cast on both sides, for example, to position 96, in order to limit the engine power irreversibly (e.g., for stationary throttled vehicle engines). The crank chamber 91 consists preferably of light metal pressure casting and the inside is finished by plunge milling or spark erosion. It is attached by a screw bolt on each side to the crankshaft main bearing 6. This major simplification can require that the upper sealing surface has a defined uneven form, which is achieved by means of spark erosion. Two or more plastic supports 99 fitted over the bolt heads 98 serve for spacesaving, vertical storage of the engines.

Finally, the very simple and compact cylinder head 14 according to the FIGS. 1 to 3 will be described. It is constructed mainly of light metal pressure casting and stiffened with ribs 101. It is fixed by means of long bolts 102 (6 for a single-cylinder engine, 9 for a two-cylinder engine etc.). A seal for gas and coolant is achieved using elastic O-rings 103. The coolant outlet 104 does not exceed the height of the engine (packing). The combustion chamber 13 is supplemented with a secondary combustion chamber 106, which is, e.g., rectangular in section and hollowed out. This is at the reversal point 10 on the inner wall (here, e.g., at 20 crank angle after top dead center 9). Accordingly, the following combustion and working sequence can be achieved.

With electronically controlled, well-timed pre-injection/pre-ignition and a rich air-fuel mixture, the pressure starts to increase in the combustion chamber 13, behaving here as a turbulence chamber, at a crank angle of 15° before top dead center 9 (see FIG. 3). Thanks to the carbon seal between piston crown 1 and cylinder head inner wall 4, mentioned on page 2, this gas pressure only has an effect on the piston strip between reversal point 7 and compression point 8 and thus already gives a small torque on the crank-shaft (and a small sideways force taken up via the guide springs 25). On further rotation of the crankshaft, the narrow seal moves (rolls) to the left between piston crown 1 and cylinder head wall 4. The piston surface, which is under increasing combustion pressure, and consequently the force due to the gas, increase greatly. The torque on the crankshaft thus increases markedly and rises progressively. On the other hand, the complementary side of the piston surface decreases, but the compressional pressure on it increases. The optimum position of the reversal point 10 must be evaluated by thermodynamic process calculations, which have not yet been carried out. Furthermore, it is still open as to whether with a running engine the constantly forming, regulating carbon or oil-carbon film, which is a result of the fine piston vibrations in the region of top dead center, will function unproblematically and noiselessly. As a variation of this, it is, therefore, intended to use a cylinder head gasket 110 (FIG. 3) made of heat-resistant fabric, whose left half is cut out in the region of the piston crown 1.

As a further possibility, FIG. 7 shows an exchangeable screwed sealing tongue 112 on the bottom of the cylinder head 121. If one succeeds in bringing this seal, for example, to the position 112; by spring elasticity, then the sealing point 8 moves to the right, to point 7. Then, a torque on the crankshaft occurs even at a crank angle of 16.5° before top dead centre (instead of a breaking torque as with conventional rocking-pistons or trunk pistons). Under the same conditions, "bringing forward the firing top centre", in accordance with the invention, results in smoother engine running without backfiring, lower gas pressure, blowback and danger of pinking, less noise, friction, wear and harmful substances, as well as smaller flywheels and starter motors and generally even lighter, more compact and economical engines (which can be easily started).

Figure 8:
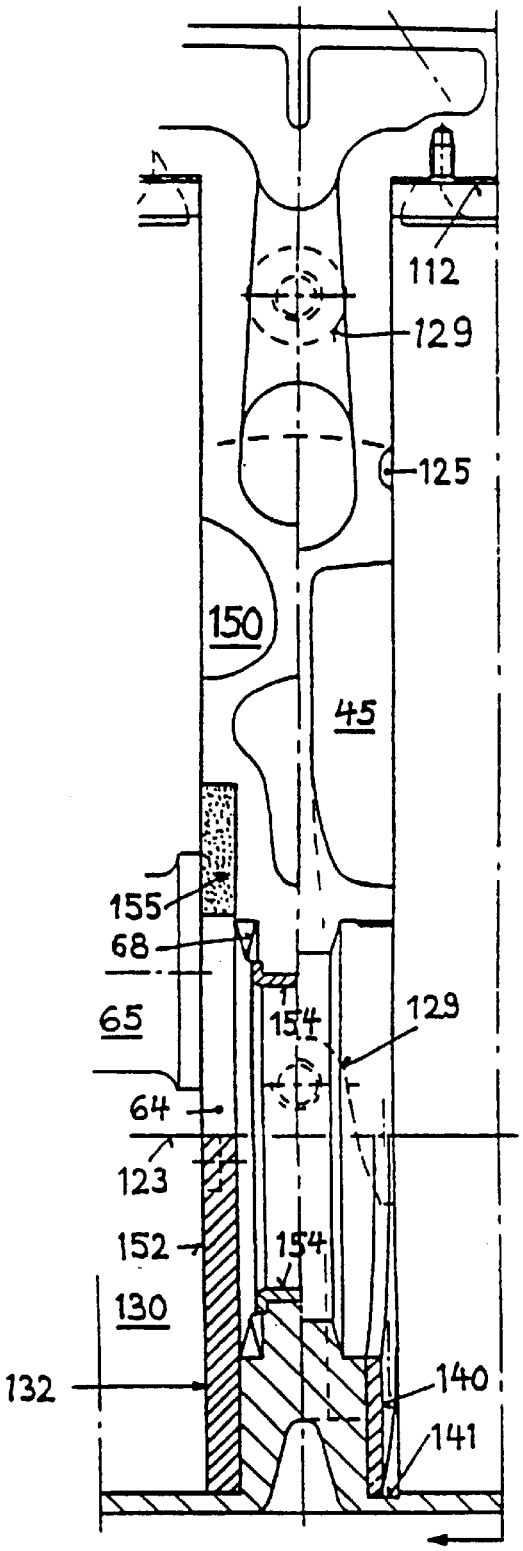
FIGS. 7 and 8 show the casing of a multi-cylinder vehicle engine (and compressor)
Figure 5:
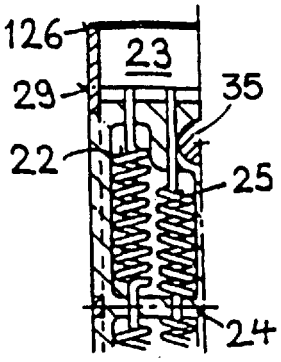
FIG. 5 shows details of the rocking-piston, outline/section.

FIGS. 7 and 8 show the casing of a possible (single or) multi-cylinder production engine in outline and partial side elevation. This casing 120 fits onto the connecting rod assembly as in FIGS. 1 to 6, and is developed as a complete monoblock with integrated cylinder head 121 and exhaust manifold 122, for the purpose of structural simplification and strengthening. It can be made of light metal casting or thin-walled cast iron or steel, and is rough and precision-machined using spark erosion, and preferably when hanging on the flat milled flange 123. This working can even include the surface of the channels 45 and the precise shape and rounding of the edges of the gas exchange ports. The rounded corners of the cylinder require correspondingly rounded corners 126 on the apex seals 23 (FIG. 5). This also applies in the case of broached or milled cylinders.

The engine casing 120 has a number of threaded eyes 129 for attachment.

The combustion chamber 13 corresponds to the one shown in FIGS. 1 to 3. Gas, petrol, diesel or multi-fuel operation are possible and interesting. This can be ascertained by purposeful and calculated choice of the following parameters: the volume, including the "air space" 106, the compression ratio when the piston position is as in FIG. 3, the charge factor of the connecting rod charger etc, and, if necessary, the use of inlet air reduction and starter mechanisms.

The crank chamber 130 has a simple air flow regulator on the left. This consists of a crescent-shaped cavity 131 (obtained by spark erosion) with the same width 132 as the cylinder and crank chamber, a spring tongue 133 of the same width with rivets 134 (or a pivoted circular sector plate) and a running through control shaft 135 with negative cams 136. The governor lever 137, when in position 137' causes the spring tongue to remain into position 133', which causes a partial return flow of the inlet air. With a rotating shaft 135 (without lever 137), single spring tongues 133 are controllable (cylinder cut-off) by suitably arranged cams all round. The version in FIGS. 7 and 8 is equally compact but more complicated and significantly more effective. In this case the side walls 138 of the crank housing are reduced conically by spark erosion to such an extent (FIG. 7*a* shows a horizontal section 139 of a corner) that an approximately half-moon-shaped piece of sheet metal 140 can be inserted as a movable side wall. Radial guidance and axial guidance (normally parallel walls) is achieved by means of slots 141. Guidance upwards to the left is via the flange facing 123 (or by striking directly at the point of application of the connecting rod charger), and to the right via the semicylindrical swivel joint 144 as in FIG. 7*a*. The movable side walls 140 are opened on both sides by 3°, for example, by means of a shaft similar to 135 with alternating right and left threads or cams slot into the corresponding counterthread or connecting points in the walls 140. Thus, at part-throttle the flow passes along the side of the lower part of the connecting rod, which reduces the charging (and the power consumption). Finally, the unique gas exchange of this engine in the shape of a letter "S" should be emphasized: the air supply 40 takes place optimally via, the integrated connecting rod charger up to closure of the inlet 146, where the left side of the connecting rod opens the return channel 147. Scavenging takes place as a direct current and with an asymmetrical valve-timing diagram (the exhaust valve opens and closes first, which is a prerequisite for genuine charging.) The narrow piston gives rise to a minimal interface between the inlet and exhaust gas flows (only 55% of a circular cylinder with the same surface area) and consequently less mixing and heat exchange of the gas flows. Since the exhaust gases are under pressure from the connecting rod charger, long, tuned single pipes can be dispensed with in favor of an integrated manifold 122 with conical-cylindrical ends 148/149 if possible on both sides. Thus, the two-part engine housing bolted together with tension rods 97 (4 in a one cylinder engine, 6 in a two-cylinder engine etc.) becomes very simply and universally applicable.

Additional variations: In place of the long scavenging channels on both sides 45/147 are short scavenging troughs 150, to which the scavenging and charging air is fed through a transverse channel in the connecting rod 36 (FIG. 1), whose lower transverse wall in top dead center position runs approximately as a line 151 and leads to two lateral connecting rod openings. This provides additional cooling on the exhaust side of the piston crown 36 and, furthermore, makes it possible to arrange internal counterweights 152 on the crank disks 64 (FIG. 2) to relieve the main bearing 154 (FIG. 8). These counterweights are at most semicircular and joined to the crank disks, e.g., by pressure welding. They are made preferentially of counterweight heavy metal (density approx. 18 g/cm$^3$) and are supplemented by complementary "volume fillers" 155, which are necessary for the connecting rod charger. They can consist of, e.g., magnesium or plastic and be attached by glueing and/or riveting. As a further variant, for the case of the ellipsoidal combustion chamber 156 of FIG. 7 the fuel-injection nozzle 157 for gas operation is aligned in the direction of the cylinder, this also being valid for the combustion chamber 13 in FIG. 1.

Figure 9:
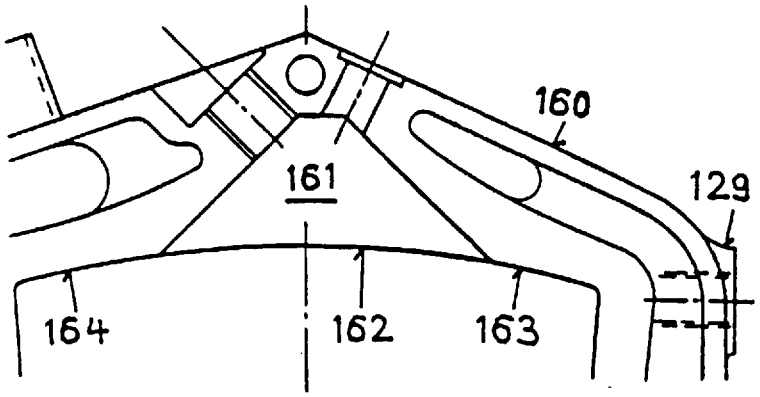
FIG. 9 shows a lean-burn version of the cylinder head in FIG. 7.

FIG. 9 shows a cylinder head 160 appropriate to FIG. 7 (and 1) with OEC's well known lean-burn combustion chamber 161 (whose position could be more to the left). The novelty consists of two squeeze surfaces 163 and 164 lying on a circular cylinder 162 with the crankshaft as centre, which function in optimal way with regard to gas flow in a time-delayed manner. With, this unproblematical and proven cylinder head, the usual braking of the piston certainly takes place before top dead center by compression and combustion gases, yet it serves only for comparative experiments and as a bridging solution, right up to the production stage of cylinder heads as in FIGS. 1, 2, 7 and 8.

Figure 10:
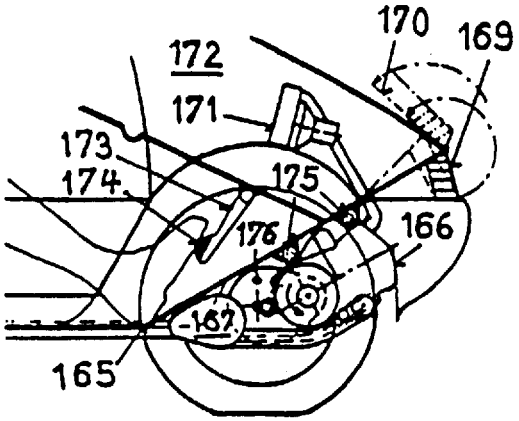
FIG. 10 shows a scaled-down outline of the front of a small car with the engine as shown in FIGS. 7 and 9.

As an example, FIG. 10 shows a "hovering-piston and conrod-charger engine" as in FIGS. 7 and 9 with 300 cm$^3$ capacity and 22 kW/30 HP per cylinder mounted transversely and tilted forwards in the front of a small car (length 250 to 330 cm, width 140 cm) according to FIGS. 1 and 1A of WO 92/20563 (Salzmann). This four to six seater (staggered) has up to the heal point 165 a front crumple zone of an astonishing 77 cm. This is only possible with the extremely compact engine 166, with "1 to 3=2 to 6" cylinders in this example, which can be pushed underneath the car floor on impact, together with its gear box and Lambda ≠ 1 catalytic converter 167 (with start converter 168, FIG. 7). For minor maintenance work (spark plugs, battery etc.) the front grill 169 and 170 which flaps open gives especially good and quick access. The radiator 171 can act as a heater and be positioned on one or both sides of a 160 liter front luggage space. The combined brake and accelerator pedal 173, with a pedal plate 174 which moves sideways against light spring force, is economical with regard to cost, saves space, acts immediately and is very safe. In moments of shock (one stretches!) it prevents undesired pressure on the accelerator pedal. The engine 166, which is suspended on elastic blocks 175 (which also act as fracture points in a collision) with multi-plate clutch and, e.g., three speed planetary gearing with uniform progression (ratio) in square, works preferentially with a twin-axis gearbox 176 with the same progression. The two freely running gear rings on the differential case, with the clutch ring between them, are changed automatically, as is also the planetary gearing. Such a "3=6F+2R" high efficiency gearbox with a progression of, e.g., 1.3 to 1.33 (spreading 3.7 to 4.16) makes it possible to drive economically and quietly both in towns, rearwards and up hills.

The engine 166 can also be mounted longitudinally without any problem (crankshaft running along the longitudinal axis of the vehicle), e.g., with a luggage rack above it, at least part of which may be flapped up. A similar concept is possible for shaft-driven motorcycles and large commercial vehicles where, thanks to automatic transmission, a "monopedal" can also be used, which in this case, however, is articulated on the floor. Moving the foot to the right causes acceleration, to the left engine brake or retarder. Both hands remain on the steering wheel.

A rocking-piston compressor according to the present invention is also interesting because of its high volumetric efficiency (especially in two-stage construction with connecting rod charger) and its simple construction without sliding valves 48. Wide transfer slots (not drawn) are divided by supports to guide the sealing mesh 29 (FIG. 3). The relatively low working pressures allow longer crankshafts and wider pistons than in FIGS. 1 and 2. The piston crown rocks tightly on a continuous gasket 112 (FIG. 7), which can encompass a separate cylinder head (FIG. 1). The openings 180 provide for exhaust of the medium, which is favorable with regard to flow, through valve tongues 181 regulated in the usual way, e.g., of coolant in cooling compressors or heat pumps. For small compressors in domestic refrigerators circular pistons are also possible.

As already mentioned in Salzmann's earlier patent applications, the compressed air for the direct fuel injection is generated individually for every cylinder by its "conrod charger" or "pneumatic pression increaser." This avoids in most simple manner OEC's separate air compressor with belt drive, air filter and air ducts and renders possible an immediate starting of the engine (possible even with a pulling cord starter). In a similar manner, an oil-dust lubrication of the crank-shaft bearings by conrod charger air is feasible.

Finally, it should be added that the geometry of the gas exchange ports of FIG. 7 has not been optimized, however the developed thermodynamic process calculation contains a corresponding program. Similarly, the cylinder curve 26 is not optimized with regard to the relative ratios of piston stroke, piston length and connecting rod length. The development of numerical methods for exact mathematical calculation of cylinder curves has, however, already been initiated several years ago by the applicant and carried out at the Federal Institute of Technology, Zurich, and by his son. The computer programs are available.

I claim:

1. A rocking-piston engine with a crankshaft and at least one connecting rod with jointless rocking-piston attached, a radius of curvature of a crown of said rocking-piston being positioned coincident with an axis of the connecting rod bearing and operatively positioned with a cylinder crankcase with at least one of a separate and integrated cylinder head, characterized by the cylinder head having an inner surface with a radius of curvature coincident with an axis of a main bearing of the crankshaft.

2. A rocking-piston engine as in claim 1 with a combustion chamber in the center of the cylinder head, characterized by squeeze surfaces formed by the inner surface of the cylinder head, situated on either side of the combustion chamber, which are activated with a time lag by the rocking piston.

3. A rocking-piston engine as in claim 1, characterized in a two-stroke engine with a rectangular, in the crankshaft direction, narrow rocking-piston, which controls the lateral gas-exchange ports asymmetrically.

4. A rocking-piston engine as in claim 1, wherein an elastic sealing tongue is fixed to an inner center of the cylinder head serving as gas-tight seal with respect to the piston crown.

5. A rocking piston engine according to claim 1, characterized in that the connecting rod is operatively positioned with minimal clearance within the cylinder and crank housing and to serve as a volumetric charger.

6. A rocking-piston engine as in claim 1 with a combustion chamber situated on the leading side of the rocking-piston in the cylinder head with a connecting channel to the cylinder, characterized by the inner surface of the cylinder head and the piston crown form a gas-tight gap that is substantially impermeable to gas when said rocking-piston is positioned at substantially top dead center.

7. A rocking-piston engine as in claim 6, characterized by fuel injection and ignition in the combustion chamber being timed so that a starting torque on the crankshaft arises before top dead center.

8. A rocking-piston engine as in claim 7, characterized by the gas-tight gap being formed by at least one of carbon deposit and oil carbon and regenerating itself continuously.

9. A rocking-piston engine as in claim 7, characterized by the gas-tight gap being formed by a seal of suitable material in the region of the inner surface of the cylinder head.

10. A rocking-piston engine as in claim 9, characterized by a piston crown seal which surrounds a cylinder head flange.

11. A rocking-piston compressor with a crankshaft and at least one attached connecting rod with a rectangular, articulation-less rocking-piston a radius of curvature of a crown of said rocking-piston being positioned coincident with an axis of the connecting rod bearing and operatively positioned with a cylinder crankcase, characterized by the cylinder crankcase having at least one of a separate and integrated cylinder head with a circle-shaped cylindrical inner surface whose radius of curvature is coincident with an axis of the crankshaft bearing, and the rocking-piston crown forming a substantially gas-tight gap with the inner surface of the cylinder head.

12. A rocking-piston compressor as in claim 11, characterized by a piston crown seal which surrounds a cylinder head flange.

13. A rocking piston compressor according to claim 11, characterized in that the connecting rod is operatively positioned with minimal clearance within the cylinder and crank housing and to serve as a volumetric charger.

14. A rocking-piston engine with a crankshaft and at least one connecting rod with jointless rocking-piston attached, a radius of curvature of a crown of said rocking-piston being positioned coincident with an axis of the connecting rod bearing and operatively positioned with a cylinder crankcase with at least one of a separate and integrated cylinder head, characterized by the cylinder head having an inner surface with a radius of curvature coincident with an axis of a main bearing of the crankshaft, wherein a top surface of said rocking-piston crown is a rolling sealing contact with said inner surface of said cylinder head when said rocking-piston is substantially in a top dead center position.

* * * * *